United States Patent [19]

Adolph

[11] Patent Number: 4,798,345

[45] Date of Patent: Jan. 17, 1989

[54] HAMMER BREAKER

[75] Inventor: Manfred Adolph, Langenfeld, Fed. Rep. of Germany

[73] Assignee: Lindermann Maschinenfabrik GmbH, Dusseldorf, Fed. Rep. of Germany

[21] Appl. No.: 99,666

[22] Filed: Sep. 21, 1987

Related U.S. Application Data

[63] Continuation of Ser. No. 815,754, Dec. 31, 1985, abandoned, which is a continuation of Ser. No. 531,813, Sep. 13, 1983, abandoned.

[30] Foreign Application Priority Data

Sep. 16, 1982 [DE] Fed. Rep. of Germany ..... 3234298

[51] Int. Cl.[4] ..... B02C 13/286

[52] U.S. Cl. ..... 241/186.2; 241/74

[58] Field of Search ..... 241/73, 74, 89.1, 87, 241/186.2, 186.3, 189 R, 189 A, 186 R; 209/352, 404, 394

[56] References Cited

U.S. PATENT DOCUMENTS

| | | | |
|---|---|---|---|
| 759,856 | 5/1904 | Borton | 241/89.1 X |
| 1,125,137 | 1/1915 | Liggett | 241/89.1 X |
| 2,317,909 | 4/1943 | Gruendler | 241/89.1 X |
| 2,734,686 | 2/1956 | Oberhellmann | 241/89.1 X |
| 3,915,395 | 10/1975 | Graf | 241/189 R X |
| 4,009,836 | 3/1977 | Strom et al. | 241/189 A X |
| 4,146,184 | 3/1979 | Whitney | 241/73 |
| 4,193,556 | 3/1980 | Linnerz et al. | 241/189 R X |
| 4,557,421 | 12/1985 | Probst et al. | 241/73 |

FOREIGN PATENT DOCUMENTS 5684647 9/1987 Japan .

*Primary Examiner*—Howard N. Goldberg
*Assistant Examiner*—Joseph M. Gorski
*Attorney, Agent, or Firm*—Toren, McGeady & Associates

[57] ABSTRACT

In a hammer breaker for breaking and crushing scrap material, particularly scrap metal, in which a hammer rotor having a plurality of hammers pivotally mounted thereon is rotatably mounted about a horizontal axis in a housing having an inlet for the material to be broken and crushed, and an outlet for broken and crushed material at the top of a shaft which is located above the hammer rotor and is arranged to receive material tangentially from the rotor, the outlet being covered by a classifying grate which extends across the top of the shaft, the grate is mounted adjustably, preferably pivotably, relative to the shaft. This enables the effective size of the grate openings through which the broken and crushed material can escape to be adjusted according to the size and density of the scrap lumps required without having to change the grate.

8 Claims, 5 Drawing Sheets

15
18
10
B
16
17
19
14
15a
1
14a
A
5
b
N
33
13
T
b
S
k
11
34
7
7
9
6
8
20
H
8
R
H
2
12
3
7
4
X
7

HAMMER BREAKER

This is a continuation division of application Ser. No. 815,754, filed Dec. 31, 1985, now abandoned which was a continuation of application Ser. No. 531,813 filed Sept. 13, 1983 now abandoned.

This invention relates to hammer breakers for breaking and crushing scrap material, particularly scrap metal, in which a hammer rotor having a plurality of hammers pivotally mounted thereon is rotatably mounted about a horizontal axis in a housing having an inlet for the material to be broken and crushed, and an outlet for broken and crushed material at the top of a shaft which is located above the hammer rotor and is arranged to receive material tangentially from the rotor, the outlet being covered by a classifying grate which extends across the top of the shaft. An example of such a hammer breaker is described and shown in German Patent No. 1,272,901. The invention also relates to a method of operating the breaker.

The processing of scrap material, e.g. car bodies and salvaged sheet metal scrap, with hammer breakers has increased significantly in recent years. The constitutional change in crude steel making processes has caused the scrap trade to make higher and higher quality requirements of the processed scrap. In the course of these developments, there is also a tendency to require differentially defined lump sizes and densities of the processed material, according to the intended use of the scrap.

The breaking and crushing of scrap in a hammer breaker of the kind described is effected by the hammers which are pivotally attached to the rotor and which are swung at high speed by the revolving rotor past anvils disposed just outside the impact circle defined by the outer edges of the hammers. The free end of each hammer strikes a non-rigid blow at any material which gets between it and an anvil, crushing, cutting or tearing the material. In this way, for instance a car body or some other bulky piece of sheet metal can be broken into a number of small pieces which are further reduced in size and compacted by the blows of the hammers. The material is then carried by the hammer rotor and thrown by the rotor or the hammers into the outlet shaft directly towards the classifying grate which covers the shaft substantially horizontally above the hammer rotor. By impingement of the pieces on the walls of the shaft and on the classifying grate, the material precompacted by the hammers undergoes additional compacting, so that approximately fist-size high-density nuggets are formed which will pass through the grate. By changing the grate used for another having grate openings of a different size and/or shape, the lump size and density of the material discharged by the breaker can be changed within the possible range. In this, the shaft plays a significant part in the classification. Pieces of scrap which do not reach the grate, and pieces which reach the grate but do not pass through it either because of hitting the grate between its openings or because of their shape and size, or low mass and insufficient kinetic energy, fall back into the shaft and may collide with oncoming material thrown up by the hammers or may be thrown against the shaft walls, undergoing additional compacting from the impact or impacts. Pieces of scrap which are not sufficiently compacted in the shaft to pass through the grate openings are further crushed by the hammers at the anvil edges adjacent the material inlet and, eventually, will be ejected through the grate. Essentially, this type of hammer breaker works satisfactorily.

Of course, requirements such as different scrap densities and lump sizes which the scrap trade may make for different materials or uses can be met only by selective use of different outlet grates with different grate openings, which means that the grate must be exchanged each time a change in the scrap properties is required. The stopping time of the machine associated with every change-over of the grate, and the resulting loss of production, is extremely uneconomical, especially as the stopping times can assume considerable proportions depending on the frequency that changes of grate are necessary. This is particularly the case with heterogeneous scrap of greatly varying composition and where the density and dimensions of the crushed scrap produced is different for different materials. Another factor adversely affecting profitability is the need to store the several different grates (i.e. with different shape and size of openings) which may be required.

An additional loss of production may also occur with the conventional form of hammer breaker due to the fact that, as explained further below, the quantity of material broken and crushed per unit time to the required size depends on the state of wear of the hammers and anvils, and the quantity of material supplied to the hammer breaker for processing must be varied accordingly. After starting up the hammer breaker or after a tool change has been made, the hammer breaker operates with relatively sharp-edged tools, so that comparatively small lumps of approximately the same size are separated from the material supplied to the inlet and a substantially constant quantity of material with a definite lump size is supplied to the outlet grate by the rotor, passing through the grate without piling up and without problems. On the other hand, when the tools have become blunt and worn, they separate or tear off from the material to be processed only coarse lumps of large surface area, which are reduced to a size able to pass through the grate openings only after repeated circulation in the hammer breaker and repeated compaction against the walls of the shaft and the bars of the classifying grate. The prolonged residence time of these lumps of material in the hammer breaker leads to an accumulation of material in the outlet shaft of the hammer breaker and a resulting reduced rate of throughput. Additionally this leads to increased wear of the crushing tools and the lining of the housing, as well as a partially undesirable higher density of the crushed scrap.

The object of the present invention is to improve the construction of hammer breakers of the kind described in such a way that different materials can be broken and crushed to different lump sizes as desired without changing the classifying grate. According to the invention, this object is achieved by mounting the classifying outlet grate across the top of the shaft so that the grate is adjustable relative to the shaft by drive means connected to the grate. With this arrangement, by adjustment of the outlet grate, which is preferably pivotably mounted about an axis adjacent the edge thereof, the areas of the grate openings which are presented to the shaft for entry of material in a direction generally parallel to the tangential discharge direction from the rotor into the shaft are adjusted, so that the size and/or density of the broken and crushed material which passes through the outlet openings can be controlled as desired without changing the grate. Whether the crushed material produced is more or less dense and smaller or larger, is determined by the angular position of the outlet grate, and the size of the grate openings projected in a plane perpendicular to the direction in which material is thrown into the shaft by the rotor.

The grate openings are preferably arranged in such a way that, when the outlet grate is closed, the grate openings are aligned with the direction of discharge from the rotor. The area of the grate openings presented to the material is then at its maximum, and crushed material in coarse lumps of relatively low density will pass through. As the grate is opened, the effective receiving area of the grate openings is reduced to an increasing extent, which means that the material which passes through is reduced in size in proportion to the decrease in the projected areas of the grate openings, while the density of the material increases in inverse proportion.

Due to the possibility of pivoting the outlet grate to different positions, the residence time of material in the hammer breaker can be varied and hence the rate of production can be adapted to the desired lump size. Consequently an accumulation of material, such as may be caused for example in conventional hammer breakers by worn crushing tools, can be completely avoided. Any non-reducible coarse pieces which may inhibit the efficient operation of the breaker, may be ejected from the housing by the rotor after opening the outlet grate wide.

So that an unnecessarily large amount of useful crushed material is not removed as well while the outlet grate is open wide for ejection of excessively coarse pieces, the outlet grate may instead by split into two portions, one of which is adjacent the pivot axis of the grate and is pivotable about the axis independently of the other portion. With this arrangement the independently pivotable grate portion may be located in line with the tangential discharge direction from the hammer rotor. The coarse pieces to be removed are thrown up by the hammer rotor directly towards the independently pivotable portion of the grate, which can thus be opened when desired to let out the coarse pieces while the other portion of the grate remains across the shaft to prevent excessive removal of other pieces of material which it is desired to retain. Furthermore, it is much quicker and easier to open and close this independently pivotable portion of the grate than it is to open and close the whole grate.

The outlet grate preferably extends across the shaft obliquely, which may be achieved for example with an arcuate grate, so that the number and negative effects of ricochets of deflected pieces of material from the grate are reduced in comparison with a horizontal arrangement of the grate. Due to the higher output or rate of production as a result of not having to change the rate, an increase in capacity of about 10 to 15% compared with conventional hammer breakers can be achieved with a breaker in accordance with the invention.

Three examples of hammer breakers in accordance with the invention will now be described with reference to the accompanying drawings, in which.

Figure 1:
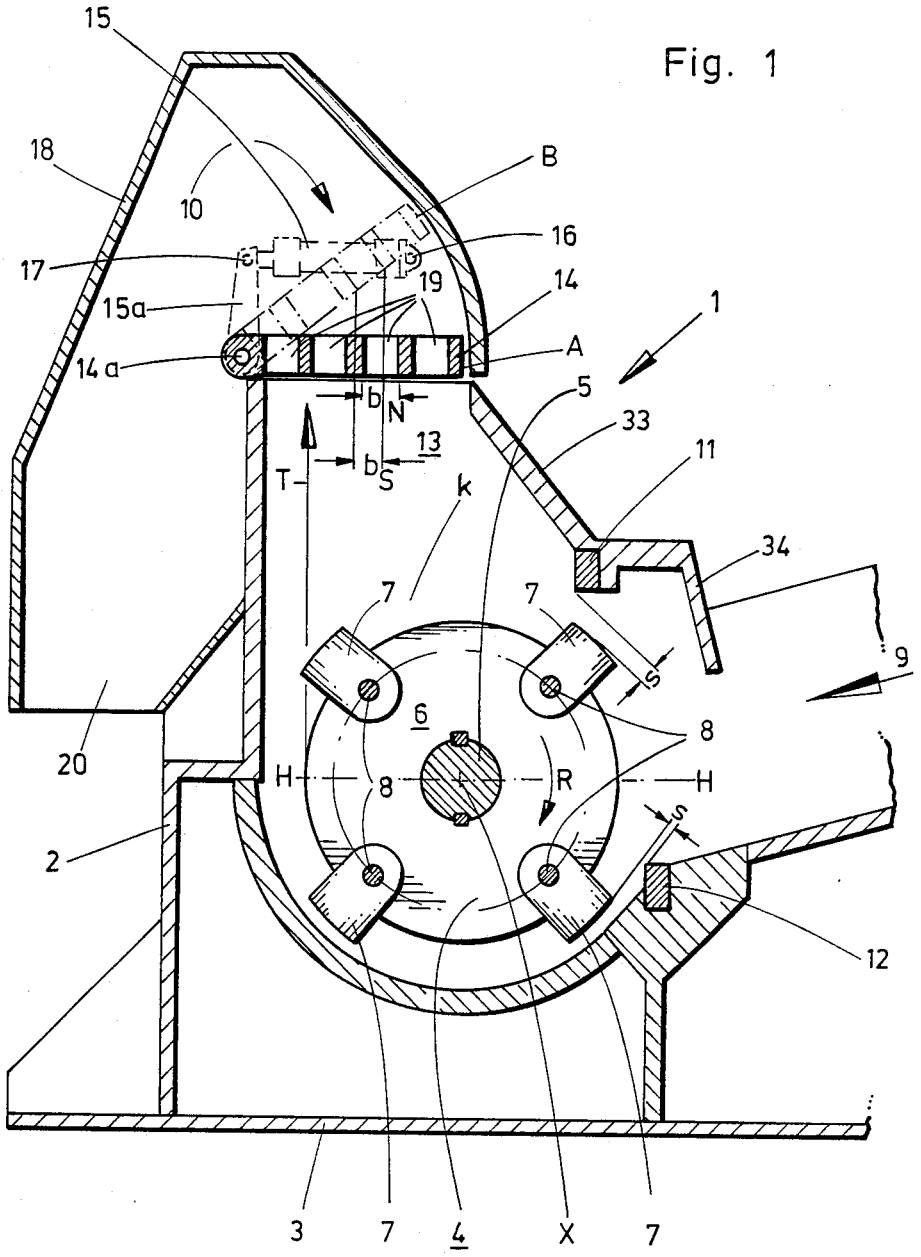
FIG. 1 is a diagrammatic vertical section through a first example in a plane perpendicular to the rotor axis.

The hammer breakers illustrated are designated by the numeral 1 in the drawings, and comprise a housing 2 which is mounted on a base plate 3. In the housing 2 a hammer rotor 4, of which the shaft 5 is mounted at both ends in bearings (not shown), is rotated in the direction R by a drive (not shown) coupled to the shaft 5. The hammer rotor 4 consists of several rotor discs 6 which are arranged with spaces between them in a row on the shaft 5 and between which hammers 7 are mounted rotatably on shafts 8 which extend through the rotor discs 6 at a radial distance from the shaft 5 and are parallel to the shaft 5.

The housing 2 is provided with a material inlet 9 located on the downwardly rotating side of the hammer rotor 4 at approximately the level of the horizontal plane H—H containing the rotor axis X. The upper edge of the material inlet opening 9 is defined by part of an exchangeable anvil 11, and the lower edge of the inlet opening 9 is defined by part of an anvil 12 which is close to but spaced from the hammer impact circle K by a gap s providing the desired degree of crushing.

The housing 2 also has a material outlet 10, which is formed by a shaft 13 located above the rotor 4 upstream of the anvil 11 relative to the direction of rotation R, and a classifying outlet grate 14 across the top of the shaft 13. The bottom of the shaft 13 is open to the rotor 4 and extends between the anvil 11 and a substantially vertical wall of the housing 2 which extends from close to the hammer impact circle on the opposite side of the rotor from the material inlet 9.

In the example shown in FIG. 1 the classifying outlet grate 14, which is provided with grate openings 19, extends substantially horizontally across the top of the shaft 13 and is mounted pivotably about a pivot axis 14*a* adjacent one edge of the grate. Two hydraulic cylinders 15, attached to a hood 18 on the housing 2 via swivel joints 17 at one end and via swivel joints 16 at the other end to levers 15a attached to the grate 14, serve to pivot the outlet grate 14 into the desired angular position relative to the shaft 13. This position is adjustable at any time according to the operating conditions and/or the required density and lump size of the crushed scrap to be produced by the machine 1. In FIG. 1, two positions are drawn for the outlet grate 14, A indicating the lowest position wherein the maximum area of the grate openings 19, represented by $b_N$, is presented to the shaft 13. Apart from adjustment of the grate position to achieve a particular density and lump size of crushed scrap throughput, the position can be adjusted to suit the degree of wear of the hammers 7. For example, position A would be set when the hammers are worn, whereas with sharp hammers position B, in which a smaller $b_S$ is presented by the openings 19, would be set to obtain the required scrap density. Naturally, settings between positions A and B may be selected according to the state of wear of the hammers and/or the desired lump size of the scrap.

In order to avoid large pieces of scrap escaping unintentionally through the outlet 10 when the grate 14 is tilted relative to the horizontal position A, the hood 18 adjacent the opening 10 is shaped arcuately to match the path followed by the end of the grate when the grate is pivoted. Beyond the outlet 10 the hood is arranged to collect the material thrown out through the grate openings 19 and to deflect it downwardly for passage out of an opening 20 to the outside.

Figure 2:
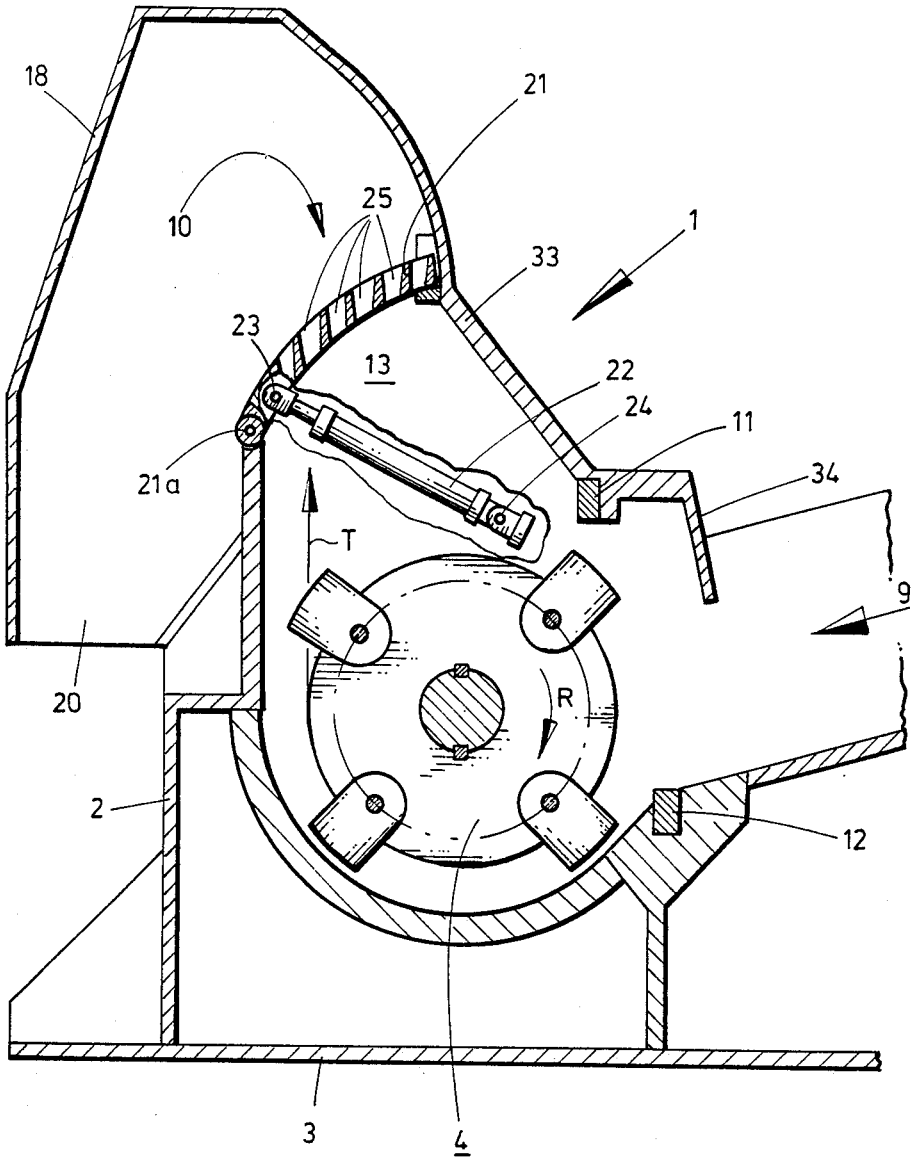
FIG. 2 is a view similar to FIG. 1 but of a second example.
Figure 3:
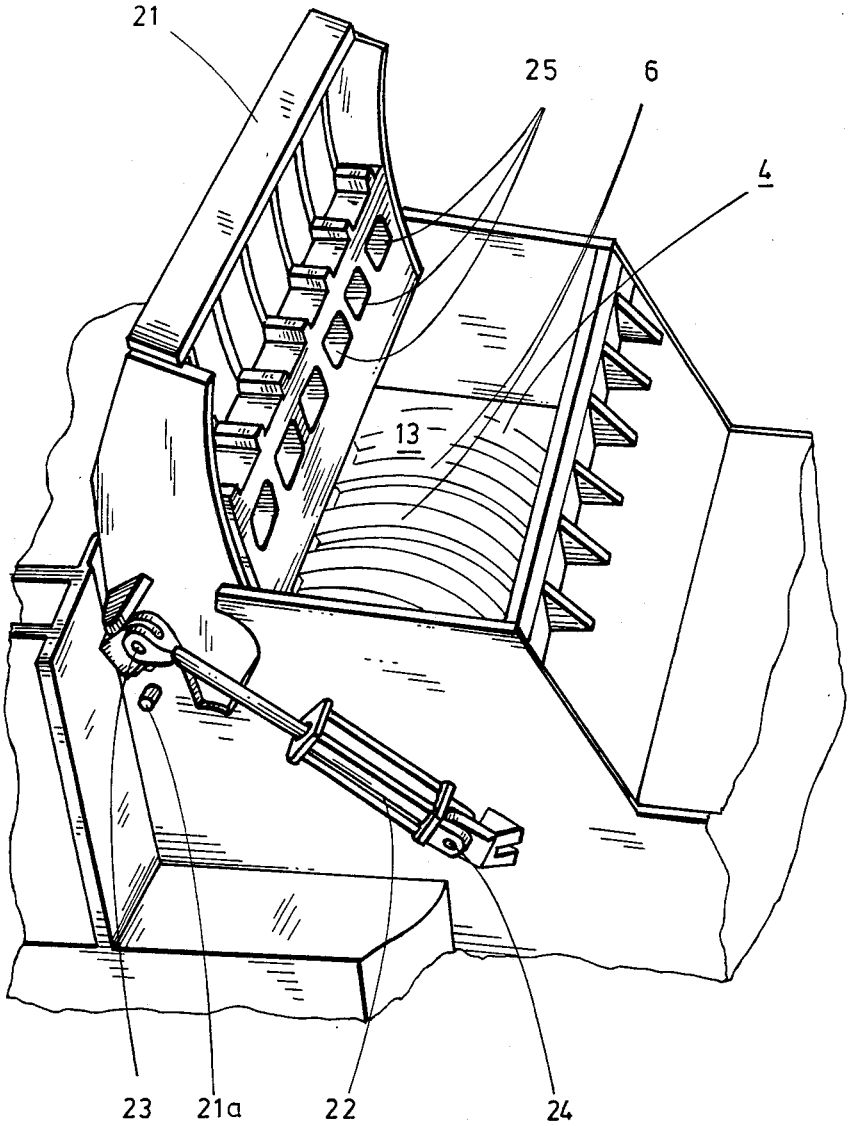
FIG. 3 is a perspective view from above of part of the hammer breaker shown in FIG. 2 with the hood removed.

In the example of FIGS. 2 and 3, the outlet grate 21, in contrast to the flat outlet grate 14 of the FIG. 1 example, is curved arcuately and extends across the top of the shaft 13 obliquely in its lowest position. The outlet grate 21 is mounted to pivot about the pivot axis 21a by means of two hydraulic cylinders 22 which are attached by swivel joints 23 at one end to the outlet grate, and by swivel joints 24 at the other end to the hammer breaker housing 2. With this curved version of the outlet grate, the maximum area of projection of the grate openings 25 is provided in its lowermost position (see FIG. 2), as in the first example. Similarly, the housing or hood wall adjacent the free end of the grate is arcuately shaped as in the first example so that it remains close to the end of the grate when the grate is pivoted in the classifying region. FIG. 3 shows the outlet grate 21 opened wide to allow any nonreducible coarse pieces of material which may be rotating in the breaker housing 2 to be ejected from the shaft 13.

Figure 4:
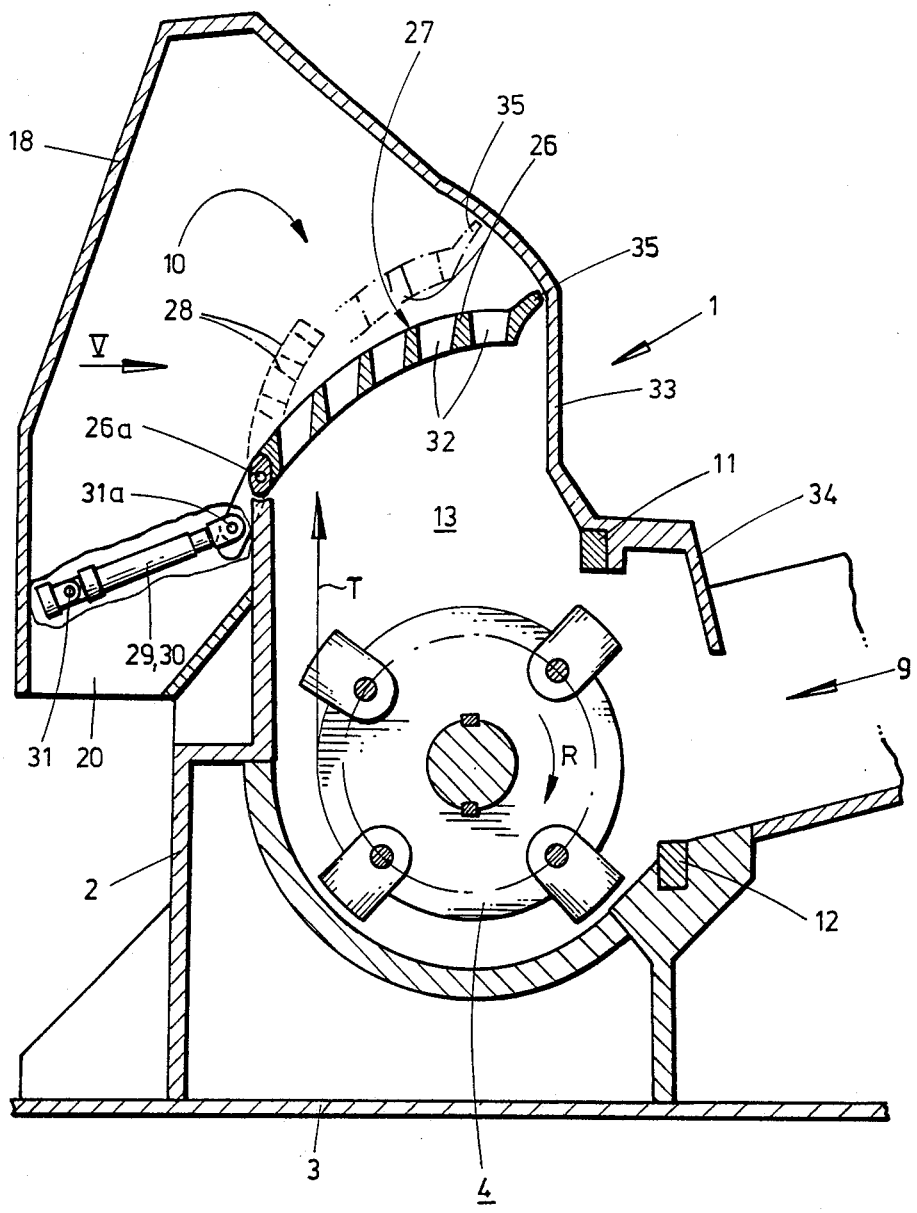
FIG. 4 is a view similar to FIG. 1 but showing the third example.

In the example shown in FIG. 4, the classifying outlet grate 26 is also curved, and has a total grate area 27 which is normally operative. A small portion 28 of this, however, is arranged to be pivotable about the axis **26*a* independently of the rest of the grate (as shown by the dash lines in FIG. 4) so that the portion 28 can be opened for ejection of coarse pieces from the breaker housing 2** while the rest of the grate remains operative.

The free end of the grate 26 is formed integrally with a lip 35 which in the various operating positions of the grate lies adjacent the housing or hood wall, which is suitably arcuately shaped as in the previous examples. The lip 35 is bent back outwardly from the interior of the shaft 13, so that a greater distance between the openings in the end of the grate and the housing or hood wall is provided above these openings, thus providing a free passage for the crushed and compacted pieces of scrap flung through these openings.

Figure 5:
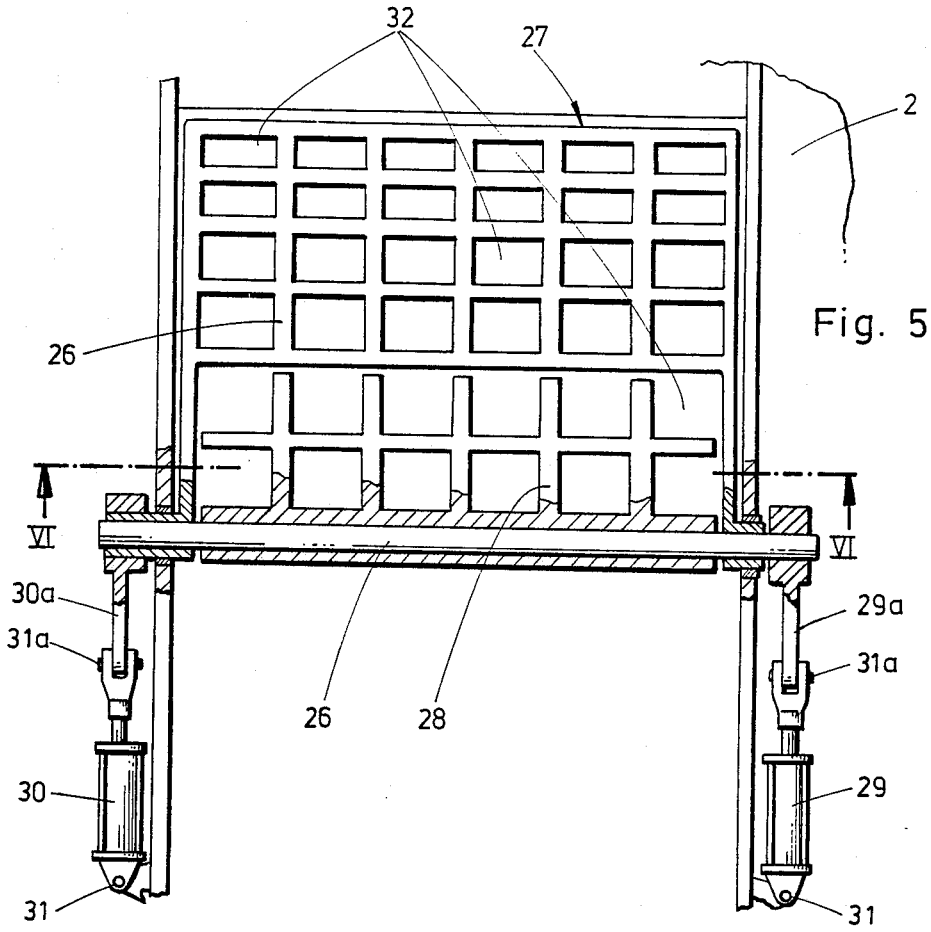
FIG. 5 is a part elevational, part sectional view of a part of the third example looking in the direction of the arrow V marked in FIG. 4; and, FIG. 6 is a cross-section taken along line VI—VI in FIG. 5.

Both the total grate 26 and the independently pivotable grate portion 28 are mounted to pivot about the same pivot axis **26*a*. The independently pivotable grate portion 28 is tilted as desired by a hydraulic cylinder 29 connected by a swivel joint 31 at one end to the breaker housing or hood, and by a swivel joint 31a at the other end to a lever 29*a* connected to the grate portion 28 (see FIG. 5). Similarly the remaining portion of the grate is pivoted by a hydraulic cylinder 30 via a pivot lever 30*a* connected to the grate. If the whole grate 26 is to be pivoted, the two portions thereof are pivoted together by means of appropriate limit switches on the hydraulic cylinders 29 and 30**.

Figure 6:
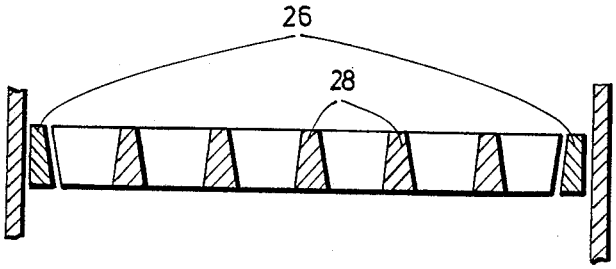

The synchronous movement of the two gate portions when the whole grate 26 is to be pivoted can be ensured in other ways if preferred, for example by means of a pin-type locking system. Another method is shown in FIG. 6, and comprises tapering the coarse-lump grate portion 28 inwards towards the shaft 13 on the three sides movable relative to the rest of the grate and correspondingly shaping the adjacent sides of the other grate portion so that when the latter is pivoted open, the coarse-lump grate portion 28 is automatically carried with it. If then, in any position of the grate 26, it becomes necessary to let coarse lumps out of the shaft 13, the coarse-lump grate portion 28 is opened further without difficulty by operating its hydraulic cylinder 29. Return to the combined closed position is likewise achieved hydraulically, although in this case it is the coarse-lump grate portion 28 which entrains and carries with it the other portion of the grate.

The mode of operation of the hammer breaker in accordance with the invention is explained in more detail below with reference to the example shown in FIGS. 2 and 3.

While the hammer rotor 4 is rotating in the direction R, material to be broken and crushed, e.g. bulk refuse or car bodies to be scrapped, is continuously conveyed through the material inlet 9 by means of feed devices (not shown) into the working zone of the rotor 4. With the anvil 12 disposed at the lower edge of the material inlet as a counter-tool, the hammers 7 of the rotor cut or tear pieces off the material supplied and throw the pieces approximately in the direction of arrow T, i.e. tangentially into the shaft 13, towards the arcuately curved classifying outlet grate 21 which is disposed across the top of the shaft 13 over its whole width and obliquely to the direction of discharge T. Pieces of material which are small enough in size and are thrown with sufficient speed exactly into the grate openings 25 pass through the outlet grate 21 immediately. On the other hand, pieces of material which are too large, have not sufficient kinetic energy, or strike the grate 21, rebound off the outlet grate 21 and fall back into the shaft to be picked up again by the hammers 7 in front of the second anvil 11. At the anvil 11 and the walls 33 and 34, further reduction in lump size takes place by crushing and impact stress before again begin carried past the anvil 12. Eventually most of the material is reduced sufficiently and passes through the openings 25 of the outlet grate 21. Pieces which are not reducible to the size of the openings 25 in the outlet grate 21 make themselves noticeable in the hammer breaker by loud noise. In this case, the outlet grate 21 is tilted by the hydraulic cylinders 22 into the open position shown in FIG. 3, whereby the material thrown up by the hammer rotor 4 can pass easily through the outlet 10 since the shaft 13 is no longer covered by the grate 21. The material is diverted outwards and then falls through the hood 18, e.g. onto a conveyor belt (not shown) disposed beneath the opening 20. After discharge of the offending material the grate 21 is closed again. In the example shown in FIG. 4, the coarse pieces are ejected through the opened grate portion 28 while the remainder of the grate stays closed.

If a smaller lump size or a denser crushed end product is desired, the angle of the outlet grate 21 is adjusted by the hydraulic cylinders 22 so as to reduce the areas of the openings 25 which are presented normally to the direction T, thus effectively reducing the sizes of the openings 25 through which material can escape. Moreover, if any accumulation of material begins to occur in the shaft at any time, the outlet grate 21 can be tilted back to increase the effective size of the openings until the accumulation is eliminated. In essence, therefore, the hydraulic cylinders 22 act as drive means in order selectively to set the grate in the various positions referred to.

Within the scope of the invention, it is also possible for the outlet grate to be provided with through-holes which, in the starting position of the grate, are angled to the tangential direction of discharge T.

I claim:

1. In a hammer breaker for breaking and crushing scrap material, such as metal scrap, to different lump sizes, said hammer breaker comprising a housing, a hammer rotor mounted within said housing for rotation about a horizontal axis, said rotor having a plurality of hammers pivotally mounted thereon rotating in a hammer impact circle, an inlet to said housing for the material to be broken and crushed, an upwardly extending shaft defined by said housing aligned above said rotor and adapted to receive broken and crushed material thrown tangentially upwardly from said rotor, said shaft having an open top end defining a material outlet spaced upwardly from said hammers, and a material classifying grate covering said outlet, wherein the improvement comprises that said shaft has a plurality of sides defining an open space which is free of obstacles between said rotor and said outlet, said hammer rotor rotates in one direction only past said shaft, anvils located within said housing adjacent the hammer impact circle and located downstream from said shaft relative to the movement of said hammers along the hammer impact circle, said housing forming a discharge passageway located along and extending from said classifying grate to a discharge opening for discharging the scrap material out of said hammer breaker after it passes through said classifying grate, said classifying grate is adjustably pivotally mounted relative to said shaft about a pivot axis extending transversely of the upward direction of said shaft and located along one side of said shaft spaced upwardly from the hammer impact circle, said grate is spaced upwardly a distance from the hammer impact circle considerably greater than the distance between the hammer impact circle and said anvils, drive means is provided for adjusting said grate about the pivot axis, said classifying grate having invariable grate openings therethrough for the passage of the broken and crushed scrap material from said shaft to said passageway and discharge opening, and said classifying grate being pivotally movable about said pivot axis as a unit along another side of said shaft opposite said pivot axis between a first position where the maximum area of said grate openings is presented to said shaft and a plurality of second positions spaced angularly from the first position where as the angular displacement from the first position increases the area of said grate openings presented to said shaft decreases, and in and between said first and all of said second positions said classifying grate extends to said another side and substantially covers said material outlet so that the broken and crushed material is discharged only through said grate openings, said drive means also selectively setting said grate in said first and said plurality of second positions.

2. A hammer breaker as claimed in claim 1, wherein said classifying grate has a lateral peripheral shape corresponding to the cross section area of said shaft, said shaft having an axis said classifying grate having lateral edges, and said classifying grate is arcuate and is mounted to extend obliquely of the axis of said shaft across said top end of said shaft.

3. A hammer breaker as claimed in claim 2, wherein said shaft axis extends from the outer radial periphery of said rotor to said open top end of said shaft, said classifying grate is arcuate and is mounted to extend obliquely of the axis of said shaft across said top end of said shaft.

4. A hammer breaker as claimed in claim 2, wherein said classifying grate is split into first and second portions, said first portion being located adjacent said pivot axis of said grate, and means is provided for pivoting said first portion about said pivot axis independently of said second portion.

5. A hammer breaker as claimed in claim 4, wherein said independently pivotable first portion of said grate is located in line with said tangential discharge direction of broken and crushed material from said rotor.

6. A hammer breaker as claimed in claim 1, wherein the cross sectional area of said shaft extending upwardly away from said rotor decreases to the first position of said classifying grate, said classifying grate pivots upwardly from the first position to the second positions, and said housing on the another side of said shaft is curved in the upward direction so that as said classifying grate is pivoted from the first position to the second positions it moves closely along the inside surface of the curved housing wall.

7. A hammer breaker as claimed in claim 1, wherein said inlet is located laterally of said rotor, said shaft is located angularly around said rotor from said inlet and is located upwardly from said inlet, and said housing including a hood covering said classifying grate and forming the passageway and the discharge opening from said housing with the discharge opening being located in said hood at a location spaced downwardly below said classifying grate.

8. In a hammer breaker for breaking and crushing scrap material to different lump sizes, wherein said hammer breaker comprises a housing in which a hammer-carrying rotor is mounted for rotation, an inlet to said housing for the material to be broken and crushed, an upwardly extending shaft defined by said housing aligned above said rotor and adapted to receive broken and crushed material thrown tangentially upwardly from said rotor, and wherein said shaft has an open top end defining a material outlet with a material classifying grate covering said outlet, wherein the improvement comprises that said shaft has a plurality of sides and defines an open space which is free of obstacles between said rotor and said grate, said classifying grate being adjustably pivotally mounted relative to said shaft about a pivot axis extending transversely of the upward direction of said shaft and located along one side of said shaft, drive means being provided for adjusting said grate about the pivot axis, said classifying grate having invariable grate openings therethrough for the passage of the broken and crushed scrap material and being pviotally movable about said pivot axis as a unit along another side of said shaft opposite said pivot axis between a frist position where the maximum area of said grate openings is presented to said shaft and a plurality of second positions spaced angularly from the first position where, as the angular displacement from the first position increases, the area of said grate openings presented to said shaft decreases, and in and between said first and all of said second positions said classifying grate extends to said another side and substantially covers said material outlet so that the broken and crushed material is discharged only through said grate openings, said drive means also selectively setting said grate in said first and said plurality of second positions.

* * * * *